US008240367B2

(12) United States Patent
Wanni et al.

(10) Patent No.: US 8,240,367 B2
(45) Date of Patent: Aug. 14, 2012

(54) PLATE HEAT EXCHANGER PORT INSERT AND METHOD FOR ALLEVIATING VIBRATIONS IN A HEAT EXCHANGER

(75) Inventors: Amar S. Wanni, Falls Church, VA (US); Thomas M. Rudy, Warrenton, VA (US); Douglas F. Slingerland, Alexandria, VA (US); Chih Pong Sin, Singapore (SG)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1358 days.

(21) Appl. No.: 11/819,592

(22) Filed: Jun. 28, 2007

(65) Prior Publication Data

US 2009/0000777 A1 Jan. 1, 2009

(51) Int. Cl.
*F28D 9/02* (2006.01)
*F28D 1/02* (2006.01)

(52) U.S. Cl. ..... 165/174; 165/153; 165/147

(58) Field of Classification Search ..... 165/152, 165/153, 174, 178, 166, 146, 167, 74; 62/525; 239/601

See application file for complete search history.

(56) References Cited

U.S. PATENT DOCUMENTS

| | | | | |
|---|---|---|---|---|
| 1,313,518 | A * | 8/1919 | Clark | 165/174 |
| 2,511,084 | A * | 6/1950 | Shaw | 165/166 |
| 2,782,010 | A | 2/1957 | Simpelaar | |
| 2,943,845 | A | 7/1960 | Jaklitsch | |
| 3,830,292 | A | 8/1974 | Wolowodiuk et al. | |
| 3,976,128 | A * | 8/1976 | Patel et al. | 165/153 |
| 3,990,838 | A * | 11/1976 | Jerde | 431/354 |
| 4,287,945 | A | 9/1981 | Hessari | |
| 4,303,124 | A | 12/1981 | Hessari | |
| 4,524,823 | A | 6/1985 | Hummel et al. | |
| 4,576,222 | A | 3/1986 | Granata, Jr. et al. | |
| 4,593,539 | A * | 6/1986 | Humpolik et al. | 62/504 |
| 5,121,790 | A * | 6/1992 | Persson | 165/140 |
| 5,513,700 | A * | 5/1996 | Kleve et al. | 165/153 |
| 5,651,268 | A * | 7/1997 | Aikawa et al. | 62/525 |
| 5,806,586 | A | 9/1998 | Osthues et al. | |
| 6,484,797 | B2 * | 11/2002 | Saito et al. | 165/153 |
| 7,967,060 | B2 * | 6/2011 | Trumbower et al. | 165/174 |
| 2002/0174978 | A1 | 11/2002 | Beddome | |

(Continued)

FOREIGN PATENT DOCUMENTS

DE 10 78 146 B 3/1960

(Continued)

OTHER PUBLICATIONS

International Search Report, PCT/US2008/006875, mailed Oct. 10, 2008.

(Continued)

*Primary Examiner* — Tho V Duong
(74) *Attorney, Agent, or Firm* — Glenn T. Barrett

(57) ABSTRACT

An insert is provided in a flow path adjacent to the input and/or output port of a plate heat exchanger to shield heat transfer elements adjacent to the port from high velocity flow. By deflecting and redirecting the high velocity flow from the port, vibration induced stress to the heat transfer elements can be minimized. The insert is provided with a converging nozzle that directs the flow into a narrowed body. The outlet of the insert can be formed as an open end of the body or as a contoured opening in the side wall of the body. Flow can also be more uniformly distributed to the flow channels defined between the heat transfer elements.

7 Claims, 7 Drawing Sheets

U.S. PATENT DOCUMENTS

| | | | | |
|---|---|---|---|---|
| 2003/0010483 | A1* | 1/2003 | Ikezaki et al. | 165/174 |
| 2003/0094270 | A1 | 5/2003 | Holm et al. | |
| 2004/0011514 | A1 | 1/2004 | Holm et al. | |
| 2004/0026072 | A1* | 2/2004 | Yi et al. | 165/175 |

FOREIGN PATENT DOCUMENTS

| | | | |
|---|---|---|---|
| DE | 197 19 251 | A1 | 11/1998 |
| EP | 0 389 971 | A | 10/1990 |
| EP | 1 180 395 | A | 2/2002 |
| FR | 1 128 148 | A | 1/1957 |
| LN | 788045 | | 6/1956 |
| WO | WO 94/14021 | A | 6/1994 |
| WO | WO 00/70292 | | 11/2000 |
| WO | WO 01/73366 | A1 | 10/2001 |
| WO | WO 2005/115604 | A1 | 12/2005 |

OTHER PUBLICATIONS

Written Opinion, PCT/US2008/006875, mailed Oct. 10, 2008.

* cited by examiner

PLATE HEAT EXCHANGER PORT INSERT AND METHOD FOR ALLEVIATING VIBRATIONS IN A HEAT EXCHANGER

BACKGROUND OF THE INVENTION

1. Field of the Invention

This invention relates to heat exchangers that experience flow induced vibrations. The invention, in particular, relates to plate heat exchangers and fluid flow at the inlet and outlet ports of heat exchangers.

2. Discussion of Related Art

A conventional gasketed-plate-and-frame heat exchanger is formed by a pack of heat transfer plates separated by gasket seals and supported between end covers that form a frame that is typically formed of a stationary cover and a movable cover, which are connected together by fasteners that clamp the heat transfer plate pack between them. The number and size of the heat transfer plates is selected based on the field of intended use of the heat exchanger. The heat transfer plates are arranged in a stacked relationship with interspaces or channels formed between adjoining plates. These interspaces are sealed from the surrounding environment by a weld or flexible seal. One of the covers, or both, is provided with port openings to allow inflow and outflow of heat exchanging fluids. The heat transfer plates have corresponding openings or plate ports that form an inlet port manifold and an outlet port manifold for each fluid through the plate pack.

Typically, two different fluids are designed to flow within the heat exchanger. In operation, the heat exchanging fluids flow separately through the plate heat exchanger in the different channels formed between the heat transfer plates. Alternating channels between plates communicate with one of the inlet and outlet port manifolds so as to define a flow area to conduct one of the heat exchanging fluids between the port manifolds. The other channels between plates communicate with the other inlet and outlet port manifolds to define another flow area to conduct the other heat exchanging fluid. A gasket or weld that is similar to, or part of, the gasket or weld around the remainder of the plates is provided around the alternating ports to create separate fluid-tight flow channels. The alternating heat exchanging fluid paths along the surface of the heat transfer plates adjacent to the channels provide for heat exchange between the fluids. In operation, fluid flows through each inlet port on a stationary or movable end cover to the corresponding inlet port manifold and is then distributed to the channels between the plates where heat exchange is effected. Then, the fluid flows from the channels into the corresponding outlet port manifold and to the outlet port on a stationary or movable end cover.

The heat exchange fluid flowing through the pack of plates can experience relatively high velocities at the inlet and outlet ports and the associated port manifolds. This is especially true in large plate heat exchangers, as used in refineries, for example. In these settings, the port velocities can be as high as 7.6 m/s (25 ft/sec.) This high velocity flow has been shown to induce vibrations in the portion of the heat transfer plates that forms the port manifold, especially in those plates positioned adjacent to the inlet and outlet ports on the stationary or removal covers. Vibration can create stresses that lead to material fatigue and failure.

Flow distributors positioned in port manifolds of heat exchangers are known. However, known flow distributors are used to shift flow to different areas of the heat exchanger or to merely more uniformly distribute flow. For example, U.S. Pat. No. 4,303,124 to Hessari is directed to a tube that may be disposed in the inlet duct or the discharge duct to distribute and collect flow, respectively, along the whole length of the ducts. The tube is disposed in the duct so that fluid may flow around the entire tube, including at the entrance and exit and through open portions in the duct. However, this design does not shield the plates in the pack adjacent to the inlet and outlet ports where the maximum fluid velocity exists.

An example of shifting flow in a heat exchanger is shown in PCT Application WO 00/70292 in which control members permit the flow medium to be guided to different sections in the plate package. However, in this type of arrangement, shifting the flow does not shield the plates immediately adjacent to the repositioned flow inlet or outlet from a high velocity fluid flow.

There is a need for a system to minimize vibrations induced by fluid flow in a heat exchanger. Additionally, it would be desirable to find a solution to the problems related to component fatigue and failure in heat exchangers due to fluid flow, particularly in plate heat exchangers.

BRIEF SUMMARY OF THE INVENTION

Aspects of embodiments of the invention relate to providing an effective mechanism for and method of alleviating flow induced vibration in a plate heat exchanger.

Another aspect of embodiments of the invention relates to providing a cost effective solution to minimizing adverse effects of high velocity flow in an inlet port manifold and/or an outlet port manifold of a plate heat exchanger.

Aspects of embodiments of this invention are directed to an insert for use in a flow path of a heat exchanger comprising a heat exchanger assembly including an inlet port for passage of a heat exchanging fluid, a port manifold extending from the inlet port and having a length and a first diameter, and heat transfer elements disposed along the length of the port manifold and having flow channels in communication with the port manifold for passage of the heat exchanging fluid to accomplish heat exchange and an insert disposed in the port manifold of the heat exchanger assembly. The insert includes a converging nozzle, a tubular body, and an outlet formed in the tubular body. The tubular body has a second diameter that is less than the first diameter. Heat exchanging fluid flows between the inlet port and the port manifold via the insert through the converging nozzle and its outlet. A flow space is defined along the length of the port manifold and extends between the tubular body and the heat transfer elements.

The invention is also directed to a plate heat exchanger comprising a frame including a first cover element and a second cover element, wherein fluid inlet and outlet ports are formed in at least one of the first and second cover elements, a heat transfer unit mounted to the frame including a plurality of interconnected spaced heat transfer elements that define port manifolds in communication with each fluid port, wherein heat exchange flow channels are defined between adjacent heat transfer elements that communicate with the port manifolds, and an insert positioned in at least one of the port manifolds in fluid communication with the associated fluid port. The insert includes a nozzle extending from the associated fluid port to confine fluid flow between the fluid port and the port manifold, a hollow body extending from the nozzle, and an outlet formed in the hollow body through which fluid flows between the insert and the port manifold. The insert forms a barrier that deflects direct fluid flow between the inlet port and the flow channels away from the heat transfer elements that are positioned adjacent to the inlet port.

The invention is further directed to an insert for use in a flow path of a heat exchanger comprising a body including an elongated chamber having a side wall, a first end and a second end and a hollow interior defining a fluid flow path, a converging nozzle disposed at the first end of the body that forms a tapered guide for a fluid stream along the fluid flow path, an outlet formed in the body through which the fluid stream flows, and means for mounting the body at a fluid port of a heat exchanger. The outlet is formed as at least one contoured opening in the side wall of the elongated chamber of the body that has a cross section that varies along the length of the body so that a velocity of the flow through the opening varies along the length of the outlet of the insert.

The invention is additionally directed to a method of exchanging heat in a fluid in a heat exchanger having a heat transfer element with an adjacent fluid flow channel and a port connected to the fluid flow channel via a port manifold comprising positioning an insert at the port so that the insert extends into the port manifold, providing a fluid flow between the port and the port manifold through the insert, and shielding the heat transfer element from direct impingement of the fluid flow from the port to reduce vibration induced in the heat transfer element from the fluid flow.

These and other aspects of the invention will become apparent when taken in conjunction with the detailed description and appended drawings.

BRIEF DESCRIPTION OF THE DRAWINGS

The invention will now be described in conjunction with the accompanying drawings in which.

In the drawings, like reference numerals indicate corresponding parts in the different figures.

DETAILED DESCRIPTION OF PREFERRED EMBODIMENTS

This invention is directed to heat exchanger assemblies and components for use with heat exchangers. As will be recognized by those of ordinary skill in the art, the invention may be implemented in various different types of heat exchanger assemblies. For purposes of simplicity, the invention is discussed in the context of a plate heat exchanger. However, the invention is not limited to a plate heat exchanger and may be implemented in any type of heat exchanger assembly or any assembly in which components are subject to vibrations induced by fluid flow within the assembly. The following detailed description, therefore, is intended to be illustrative and not limited to the particular types of heat exchanger components described.

Basically, the invention is directed to an insert for use with a heat exchanger that is placed in the fluid flow path adjacent to an inlet or outlet port to more uniformly distribute fluid flow to the flow channels within the heat exchanger and to prevent direct impingement of high velocity fluid flow against elements that are subject to vibration induced by the fluid flow. The insert shields the susceptible components from high velocity fluid flow, in particular, to reduce vibrations that would be created in the components from the high velocity flow. In accordance with this invention, the vibrations and resulting adverse affects, such as material fatigue and component failure, can be avoided.

The terms used herein are intended to be conventional in the sense of their commonly accepted meanings in the art, especially in the art of heat exchangers and fluid flow. However, it will be recognized by those of ordinary skill in the art that many of these terms can be used interchangeably with similar terms. For example, the term port is intended to describe an opening through which fluid flows and is often used to describe openings in end covers and heat transfer plates or even a series of aligned openings defining a flow path. Similar terms include flow paths, channels, or manifolds. As this disclosure is intended to explain the invention using a common application in the field, it will be understood that these terms are not intended to be limiting.

Figure 12:
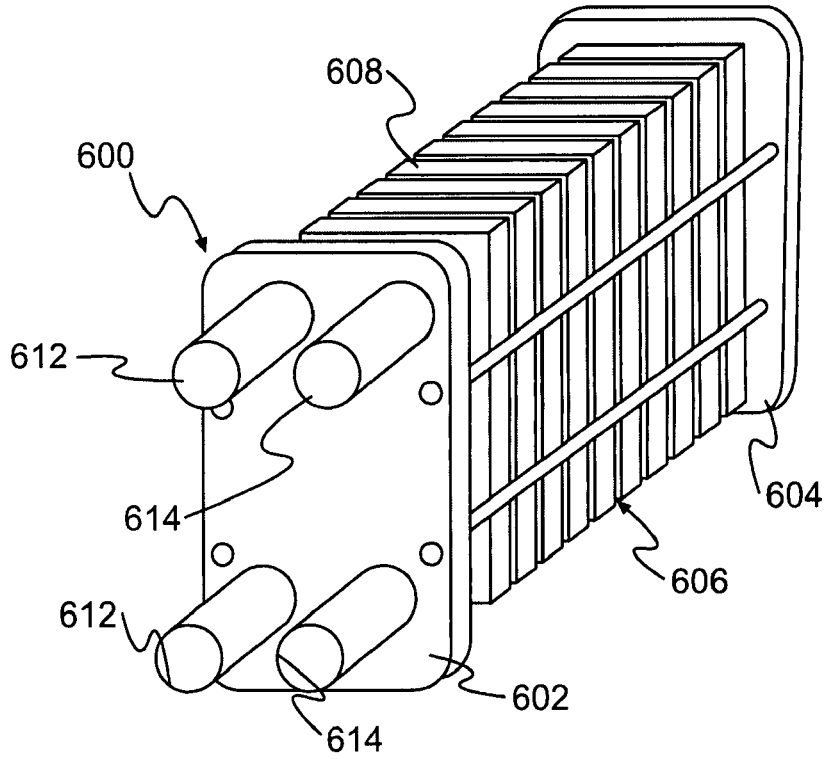
FIG. 12 is a front perspective view of a plate heat exchanger assembly.
Figure 13:
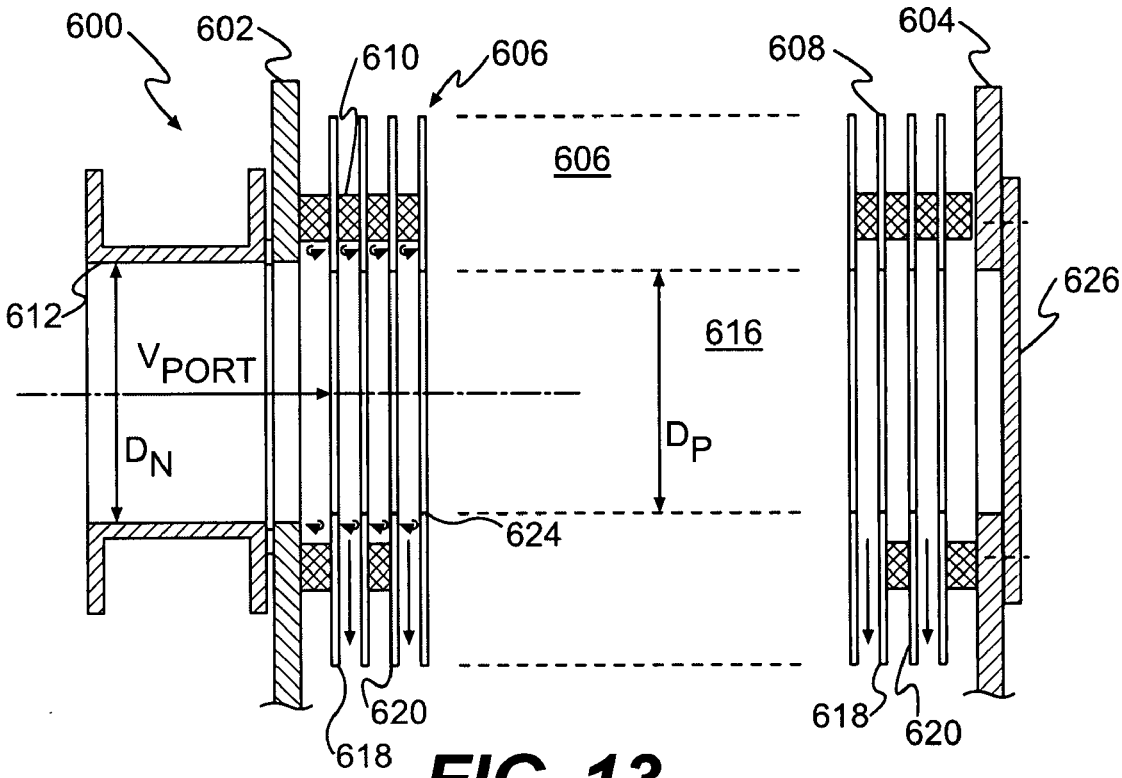
FIG. 13 PRIOR ART
FIG. 13 is a schematic side view in partial section of a conventional plate heat exchanger assembly.

FIG. 12 shows an exterior view of a conventional plate heat exchanger 600, in which this invention could be used. FIG. 13 shows the interior view of the conventional plate heat exchanger 600 without the insert in accordance with this invention. The plate heat exchanger 600 is formed with end covers that form a frame including a stationary cover element 602 and a movable cover element 604 that support a plate pack 606 of heat transfer elements 608. The stationary cover element 602 is fastened by bolts, for example, to the movable cover element 604 to hold the plate pack 606 between them.

For clarity, the central portion of the plate pack 606 is represented by dashed lines, but it will be understood that the plate pack 606 includes a continuous stack of heat transfer elements 608 arranged between the stationary cover element 602 and the movable cover element 604. As is known, the heat transfer elements 608 are arranged in a stacked, spaced configuration with sealing gaskets 610 disposed between adjacent plates.

As seen in FIG. 12, typically the plate heat exchanger 600 has a pair of inlet ports 612 and a pair of outlet ports 614 with one inlet port 612 and one outlet port 614 each connected to a separate port manifold in communication with a flow channel defined between alternating pairs of adjacent plates 608. By this, one fluid flows on one side of a heat transfer element 608, while another fluid flows on the other side of the heat transfer element 608 to accomplish a heat exchange between the fluids. Typically, the inlet port 612 and the associated outlet port 614 are offset and disposed diagonally with respect to each other as seen in FIG. 12 and can be appreciated from FIG. 15. In this disclosure, the inlet and outlet ports 612 and 614, respectively, are broadly designated to include the openings in the corresponding cover elements and any associated structure, which in this case are spool extensions. Of course, any structure forming the inlet and outlet ports into the plate heat exchanger 10 would be included, or the inlet and outlet ports can merely be the openings in the cover elements.

FIG. 13 shows inlet port 612 formed in the stationary cover element 602 so as to connect to port manifold 616 that leads to flow channels 618. The inlet port 612 has an interior diameter $D_N$ that in this case is the same as the interior diameter $D_P$ of the port manifold. It is also possible to have different diameters. Adjacent flow channels 620 would be fed by the other inlet port and associated port manifold. As noted above, the inlet port 612 could also be simply formed as an opening in the cover element 602 without the spool extension shown.

Figure 15:
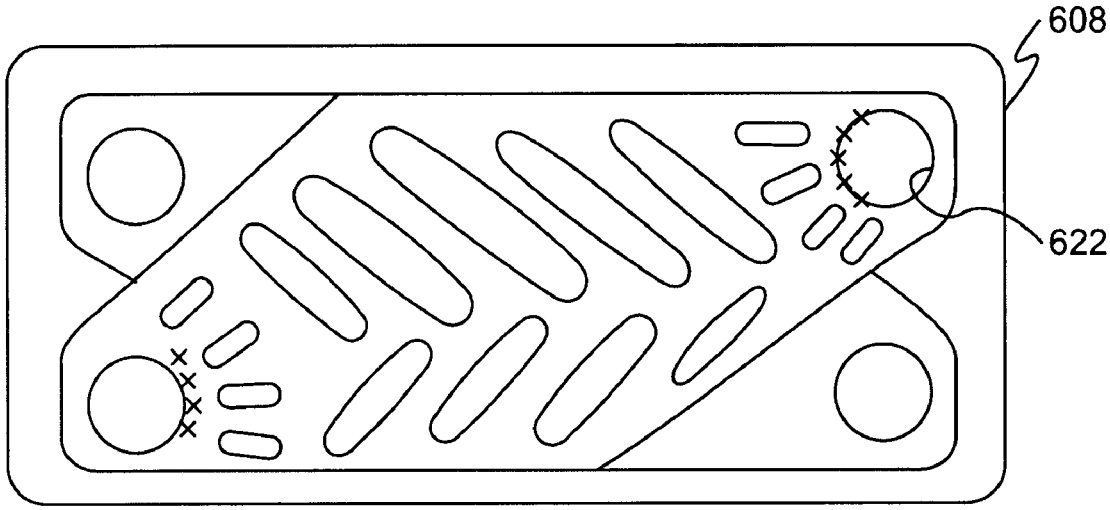
FIG. 15 PRIOR ART

FIG. 15 shows a typical heat transfer element 608. Each heat transfer element 608 is a plate formed of conducting material with openings or heat transfer element ports or plate ports 622 formed therein that will define the port manifold 616 when the plates 608 are aligned and sealed together, as seen in FIGS. 12 and 13. The end of the port manifold 616 is sealed with a blank or blind flange 626 secured to the movable cover element 604. It is also possible to form the inlet and outlet ports in the movable cover element 604 instead of, or in conjunction with, the stationary cover element 602.

Figure 14:
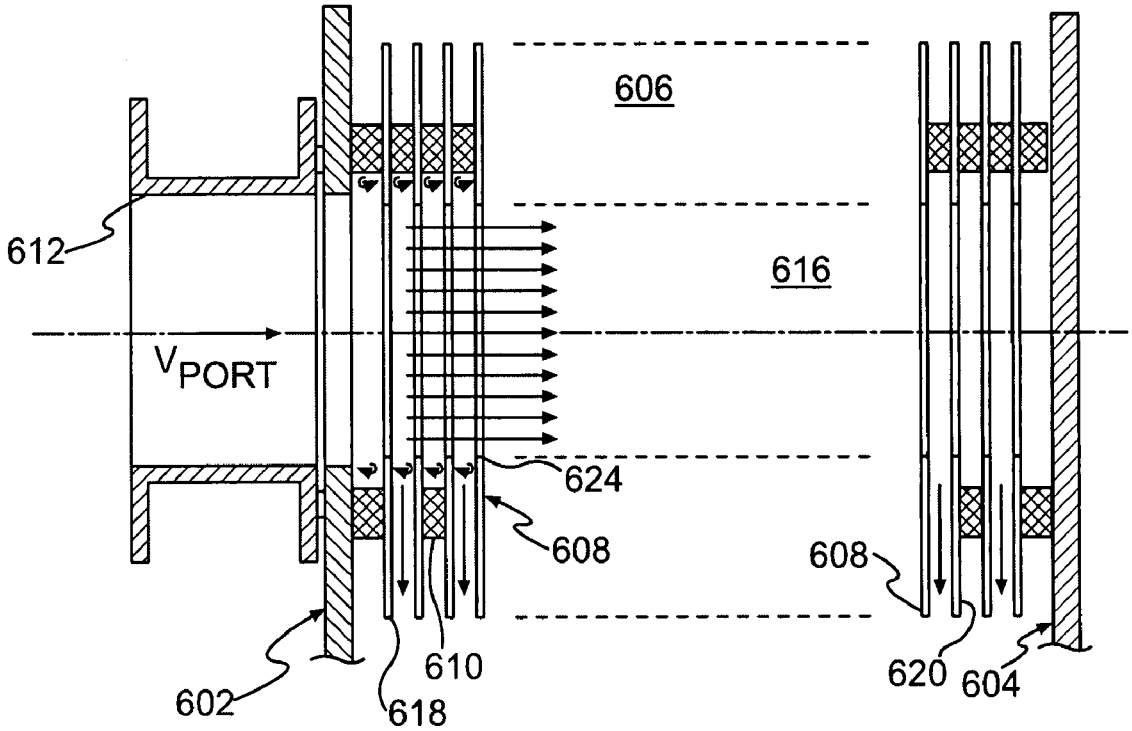
FIG. 14 PRIOR ART
FIG. 14 shows the fluid flow in the conventional plate heat exchanger of FIG. 13; and, FIG. 15 is a plan view of a heat exchanger plate in accordance with a conventional design.

In operation, as illustrated in FIG. 14, a fluid is introduced to the plate heat exchanger 600 through the inlet port 612 at a velocity $V_{port}$ and flows into the port manifold 616. The fluid flows across the entire diameter $D_P$ of the port manifold 616. As will be appreciated from FIG. 14, the fluid flow directly impinges on the edges 624 of the plate ports 622 in the heat transfer elements 608. Arrows represent the swirls induced in the flow at the edges 624 of the flow channels 618. As is known in the art of fluid dynamics, the flow will dissipate along the length of the port manifold 616 as the fluid flows within each flow channel 618 between the plates 608. However, the velocity of the fluid flow adjacent to the plates 608 positioned nearest to the inlet port 612 will be at its highest value when entering the port manifold 616. A similar phenomenon occurs at the port manifold leading to the outlet port 614.

In large plate heat exchangers, the velocity $V_{port}$ can be very high. This high velocity flow stream tends to impinge directly on the edges 624 of the plate ports 622 in the heat transfer elements 608 adjacent to the inlet port 612. The inventors have discovered that heat transfer elements 608 located adjacent to the inlet port 612, and also adjacent to the outlet port 614, experience high vibrations due to the fluid flow. When liquid flow rates are in excess of 4.5 m/s (15 ft/sec), plate vibration is possible. Such flow induced vibration can lead to eventual failure of the heat transfer element 608. A Root Cause Failure Analysis (RCFA) illustrates the failure owing to flow-induced vibrations. A detailed analysis indicates that both low-cycle and high-cycle fatigue failures occur and supports vibration root cause. FIG. 15 shows cross hatched portions at the edge of the heat transfer element port 622 where failure tends to occur.

As the heat transfer elements 608 are typically formed as stamped plates supplied in certain standard sizes, it would be expensive and complicated to change the size of the plate ports 622 to accommodate the increased flow. Since the diameter of the plate ports 622 is essentially fixed, the inventors of this invention have developed a way to accommodate the high velocity within a standard assembly.

Figure 1:
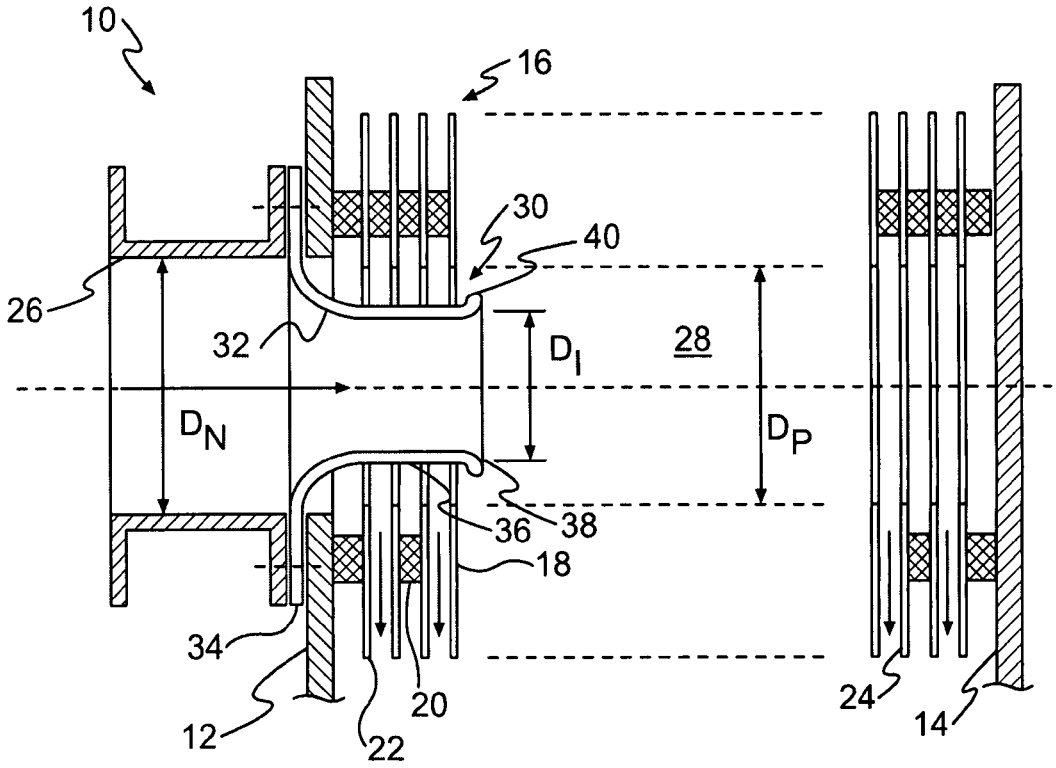
FIG. 1 is a schematic side view in partial section of an insert disposed within a heat exchanger in accordance with one embodiment of the invention.

Referring to FIG. 1, this invention proposes installing an insert at the inlet port area and/or outlet port area of a heat exchanger assembly to prevent direct impingement of the liquid flow at the edge of the plate ports in the heat transfer elements adjacent to the inlet port area and/or the outlet port area. The insert will also more efficiently and uniformly distribute the flow into the port manifold within the pack of heat transfer elements. The insert in accordance with this invention causes the fluid flow to flow outwardly (or inwardly) in a narrowed plume within the port manifold, which effectively shields the edges of the plate ports in the heat exchanger plates nearest to the inlet port and the outlet port from the high velocity flow that causes vibrations.

Figure 2:
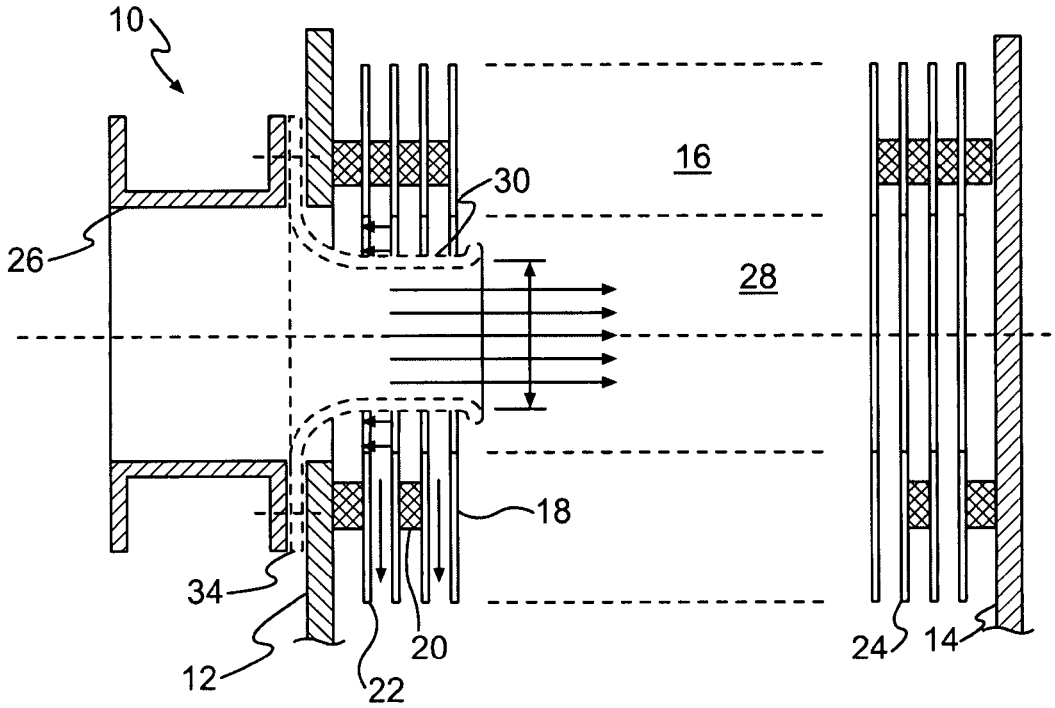
FIG. 2 shows the fluid flow in the heat exchanger when the insert in accordance with FIG. 1 is used.

The plate heat exchanger 10 shown in FIGS. 1 and 2, similar to that shown in FIGS. 12-14, has a frame including a stationary cover element 12 and a movable cover element 14 that are secured together to clamp a pack 16 of heat transfer elements 18 together in a spaced relationship. The heat transfer elements 18 are secured in a stacked, spaced relationship by sealing gaskets 20 and define flow channels 22, 24 between adjacent alternating pairs of elements 18. Again, the plate pack 16 is shown partially dashed for purposes of simplicity but would include elements 18 extending entirely between the cover elements 12 and 14.

An inlet port 26 is formed in one of the cover elements, in this case the stationary cover element 12. The inlet port 26 is used to broadly designate the inlet into the plate heat exchanger 10 from an external source through the cover element 12, which can include any structure associated with the opening in the cover element 12. In the illustrated case shown herein, the inlet port 26 includes the spool extension and the port/opening in the cover element 12. A port manifold 28 extends from the inlet port 26 through openings or plate ports in each of the heat transfer elements 18 to the other cover element, in this case the movable cover element 14. A blank flange can be provided to seal the port manifold 28 of the cover element 14 if it is open. An outlet port, similar to that seen in FIG. 12, would be arranged in the same manner leading from a port manifold at the other end of the plate pack 16.

An insert 30 is provided at the inlet port 26 in the port manifold 28 as seen in FIG. 1. An insert can also be provided at the outlet port. For purposes of simplicity, the insert 30 is described herein with respect to the inlet port 26, but it should be recognized that the description is applicable to an installation at the outlet port as well since the port manifold leading to the outlet port will experience the same high velocity issues.

The insert 30 is formed as a hollow tubular member having a first end formed as a converging nozzle 32. The opening diameter of the converging nozzle 32 is selected to be the same or close to the same diameter $D_N$ as the diameter of the inlet port 26 to promote a smooth flow of fluid into the insert 30. The converging nozzle 32 preferably has an annular mounting flange 34 that functions as a mount to connect the insert 30 to the heat exchanger 10. As seen in FIG. 1, the mounting flange 34 is sealed between the inlet port 26 spool and the stationary cover element 12 by gaskets, for example. However, it is contemplated that the mounting flange 34 can connect to other portions of the heat exchanger 10, including the inside of the stationary cover element 12 or the first heat transfer element 18 adjacent to the inlet port 26. It is also possible to form the nozzle 32 integrally with the inlet port 26, the covers 12, 14, or one of the heat transfer elements 18.

Extending from the nozzle 32 is a hollow, tubular elongated body 36. An outlet 38 is formed in the body, in this case as an open end of the body 36. The body 36 defines a flow path for the fluid to flow from the inlet port 26 through the nozzle 32 and out of the outlet 38. Of course, if the insert 30 is used at an outlet port, the flow direction would be reversed. The body 36 can have a constant diameter or be tapered toward the outlet 38. The edge of the outlet 38 can be rounded to facilitate flow as fluid flow is enhanced around smooth or curved surfaces, as is known. As seen in FIG. 1, a rounded lip 40 surrounds the open end of the outlet 38.

The insert 30 can be made of any rigid material. For example, the insert 30 may be made of metal, including forged steel, rolled steel or titanium. The insert 30 may also be made of fiber reinforced glass, plastic or plastic composites. The insert 30 may be made as one piece or assembled with a separate nozzle 32 and body 36. It is also contemplated that stiffeners can be added if the particular application requires added rigidity or strength. Stiffeners can be formed as elongated ribs extending from the body 36, cross bars extending across the hollow interior of the body 36, or perforated rings extending around the body 36. In any event, the stiffeners would allow fluid to flow around and through the insert 30 without significant impediment.

The insert 30 extends into the port manifold 28 at least to the first heat transfer elements 18 so that flow exiting the outlet 38 does not directly impinge on the edges of the ports in the heat transfer elements 18 that define the port manifold 28 to shield the edges from the highest velocity flow, which can cause vibration and wear on the elements 18, as discussed above. The insert 30 in this embodiment has a length less than the length of the port manifold 28. The insert 30 length can be from about 5% to about 25% of the length of the port manifold 28, for example. The outlet 38 has a diameter $D_I$ that is less than the diameter $D_P$ of the port manifold 28. The outlet diameter $D_I$ can be from about 50% to 90%, or more preferably from about 70% to 80% of the port manifold diameter $D_P$. While each of these values can optimize results, it is possible to vary the values depending on the particular fluid flow and type of heat exchanger assembly used.

The configuration of the insert 30 as it extends partially into the port manifold with a more narrow outlet causes the fluid entering the heat exchanger to form a plume with a high velocity at its center and diminishing velocity as the flow dissipates into the port manifold and disperses into the existing fluid in the port manifold 28 before being channeled into the flow channels 22 extending between the heat transfer elements 18. This plume effect prevents the edges of the ports of the heat transfer elements 18 from experiencing the direct impact of high velocity flow entering from the inlet port 26 that occurs in prior art arrangements. The heat transfer elements 18 disposed directly adjacent to the port 26 receive fluid that has exited the outlet 38 and then flowed in the space between the insert body 36 and the initial heat transfer elements 18 to pass into the flow channel 22. FIG. 2 illustrates how the fluid flowing from the port 26 is concentrated in the central region of the port manifold 28 with the arrows pointing to the right in the figure. The small arrows pointing to the left in the figure show that fluid flows back toward the heat transfer elements 18 disposed directly adjacent to the port 26 after being distributed into the port manifold 28.

The insert 30 distributes fluid flow and shields the edges of the heat transfer elements 18 from damaging high velocity flow, especially in large plate heat exchangers used in industrial settings, such as in petroleum or petrochemical refineries. For example, use of the insert 30 in a plate exchanger can increase the central velocity of the fluid flow in the port manifold to about 1.3 normal flow velocity, which dissipates and causes the flow velocity experienced at the edge of the ports of the heat transfer plates adjacent to the port manifold to reduce by a factor of 2. The kinetic energy level (proportional to density x velocity x velocity) of the fluid at this location can be reduced by a factor of 4.

It will be appreciated by those of ordinary skill in the art of fluid dynamics and heat exchangers that the velocity of the fluid (assumed to be a liquid) flow exiting the heat exchanger at the outlet port will be approximately the same magnitude as when it entered. Thus, channeling the exiting fluid into an insert 30 in the port manifold leading to the outlet port will also have the same beneficial effects described above by shielding the edges of the heat transfer element ports from the highest velocity flow and minimizing vibration and wear to the heat transfer elements 18. The insert in accordance with this invention can be used at the inlet to the plate heat exchanger, at the outlet of the plate heat exchanger or at both the inlet and the outlet, depending on the desired application and the particular system characteristics.

Figure 3:
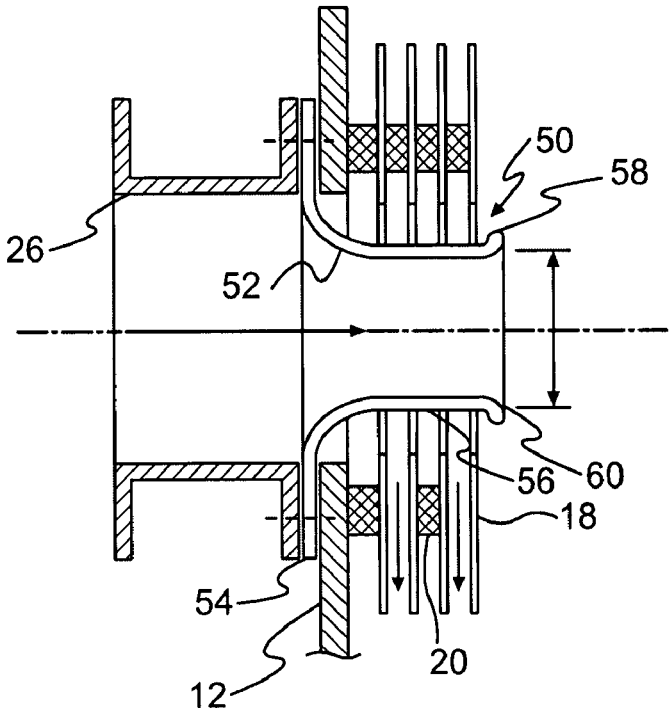
FIG. 3 is a partial schematic side view in partial section of an insert similar to FIG. 1 with a modified lip design.
Figure 4:
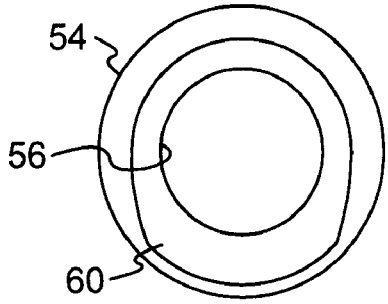
FIG. 4 is a front view of the insert of FIG. 3.

FIG. 3 shows a modification of the insert 50. In this case, the insert 50 has a converging nozzle 52, a mounting flange 54 and body 56 similar to the insert 30 in FIG. 1. The outlet 58 has a lip 60 that extends outwardly on one side toward the open channels, as seen in FIG. 4, toward the heat transfer elements 18. The extended lip 60 assists in shielding the heat transfer elements 18 from the high velocity flow exiting the insert 50. The lip 60 acts as a spillway of sorts. Although the lip 60 is shown extending essentially perpendicular to the body 56, it could also extend at an angle to slope outwardly from the outlet 58.

Figure 5:
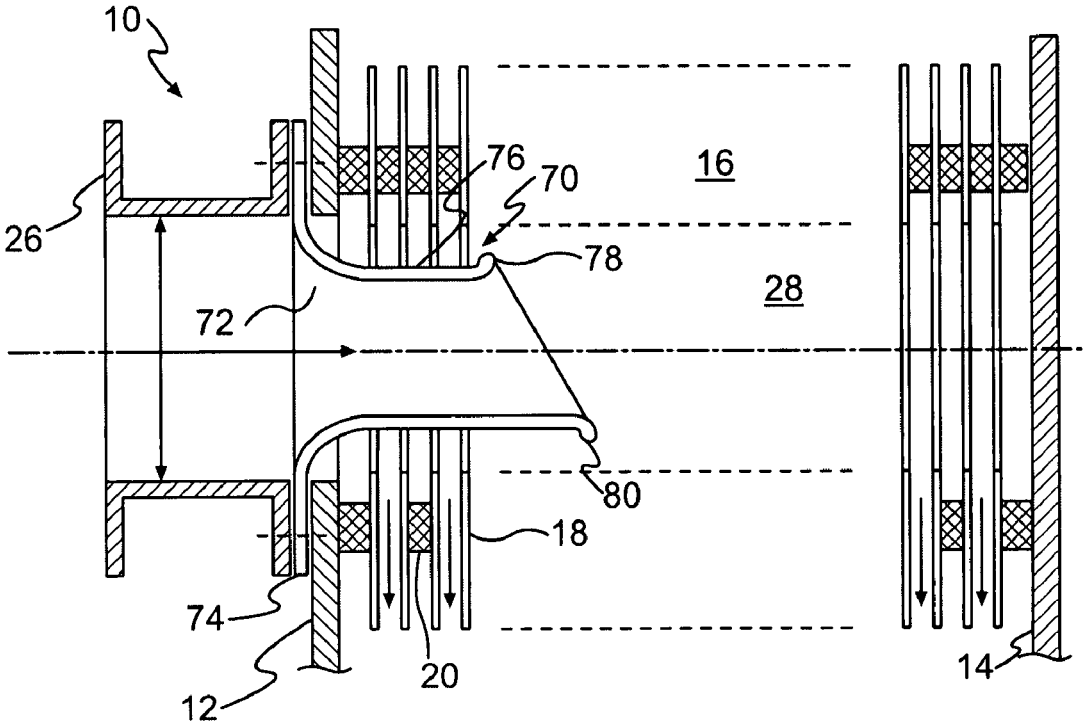
FIG. 5 is a schematic side view in partial section of an insert similar to FIG. 1 with a modified outlet.

FIG. 5 shows another modification of the insert 70. In this configuration, the insert 70 has a converging nozzle 72, a mounting flange 74, a body 76 and an outlet 78 that is angled. A rounded lip 80 extends around the outlet 78 and could also be enlarged if desired, as in the embodiment shown in FIG. 3. Angling the outlet 78 causes the opening to be larger and causes one side of the wall that forms the body 76 to be longer than the opposed side. The longer side wall also functions as a spillway shielding the heat transfer elements 18 from direct impingement of the fluid flow.

It any of the configurations of the inserts, the outlet can be shaped to influence the flow pattern in accordance with fluid dynamic principles. It is also possible to form slots or perforations in the body to allow some fluid to exit the insert before the main outlet, but still shield the heat exchanging elements from direct high velocity fluid flow impingement.

The inserts shown in FIGS. 6-11 form the outlet in the side wall rather than as an open end. A similar shielding effect is obtained with this arrangement along with a more uniform distribution of flow along the port manifold.

Figure 6:
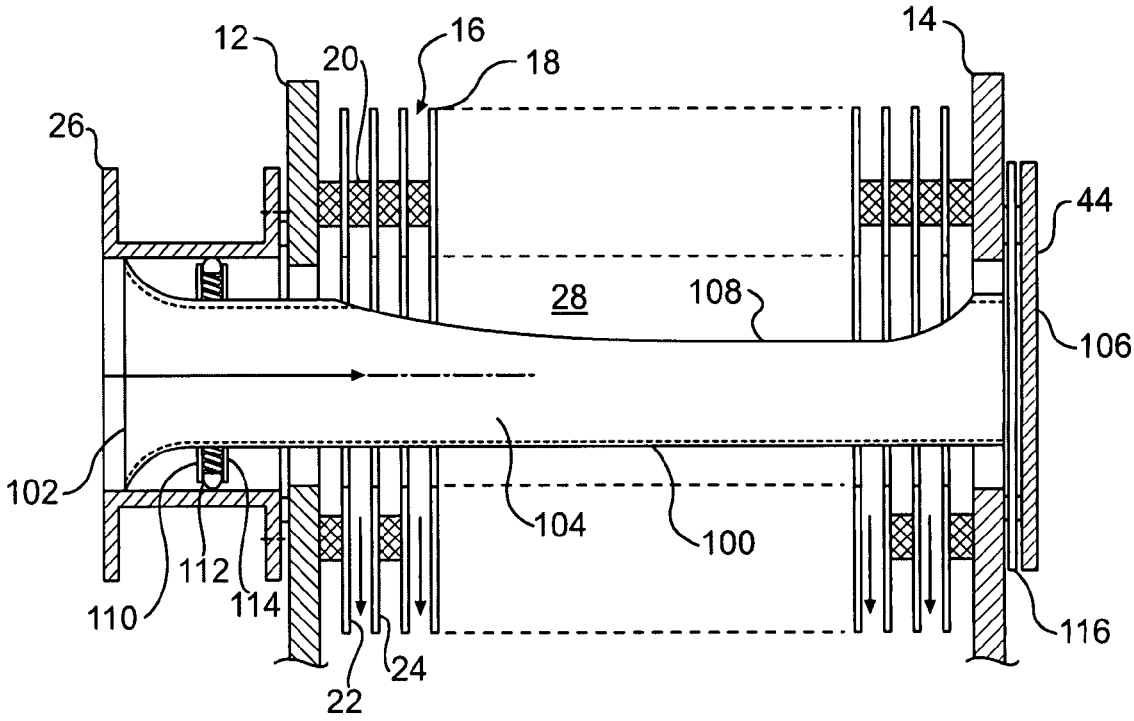
FIG. 6 is a schematic side view in partial section of an insert disposed within a heat exchanger in accordance with another embodiment of the invention.
Figure 10:
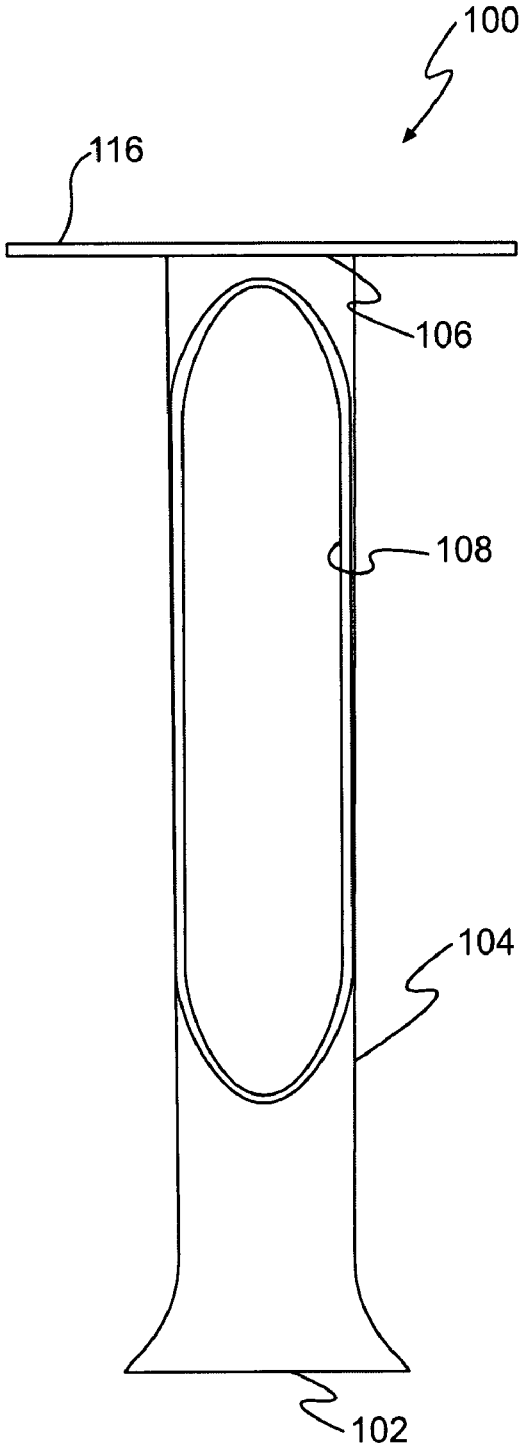
FIG. 10 is a top view of the insert of FIG. 6.

Referring to FIG. 6, an insert 100 is formed with a converging nozzle 102 at a first end leading to a hollow tubular body 104. The second end 106 of the insert 100, which extends the whole length of the port manifold 28, is positioned at the movable cover element 14. The second end 106 can be formed as a closed end or can be closed by the cover element 14. An outlet 108 is formed in the side wall of the body 104 as a contoured opening. The outlet 108 has a variable cross section so as to distribute the flow in a uniform manner along the length of the port manifold 28. As will be appreciated by those of ordinary skill in the art of fluid dynamics and heat exchangers, the fluid pressure varies along the length of the port manifold due to static fluid forces imposed by the existing fluid and by dynamic forces induced by the fluid flowing out of the port manifold to the flow channels in the plate pack 16. The opening of the outlet 108 is contoured to take into account the variables that impact the flow and is designed to distribute the fluid in a generally uniform manner. One shape of the opening of the outlet 108 is shown in FIG. 10, for example.

The opening of the outlet 108 is disposed on the side of the insert 100 that is opposed to the edges of the heat transfer elements 18 leading to the flow channels 22 so that the fluid is deflected upward, in the case of FIG. 6, which shows the top inlet port 26, in a direction opposite to the flow into the flow channels 22 of the plate pack 16. The fluid thus must flow around the insert 100 and, by this, diminishes in velocity at the point that it impacts the edges of the heat transfer elements 18. With this arrangement, flow induced vibration does not occur, nor do the deleterious effects of the vibration.

In the configuration of the insert 100 of FIG. 6, the converging nozzle 102 is disposed within the inlet port 26 with the outlet 108 opening beginning at the first heat transfer element 18 and flow channel 22, seen at the far left in the figure. The insert 100 is mounted in the heat exchanger so as to be centrally aligned within the port manifold 28. The first end of the insert 100 is mounted by a sleeve 110 disposed around the nozzle 102 that carries a spring biased stabilizing mount formed of a contact 112 and spring 114 supported in the sleeve 110. The contact 112 is biased outwardly by the spring 114 to press against a heat exchanger support surface, in this case the inlet port 26 spool. This arrangement maintains the insert 100 in a central aligned position and resists dislodgement. The second end of the insert 100 has a mounting flange 116, formed as a plate that is coupled to the movable cover element 14. As seen, a blind flange 44 is used to seal the unused port opening the movable cover element 14. The mounting flange 116 is sealed between the movable cover element 14 and the blind flange 44 with a gasket, for example. Of course, it is also possible to mount the second end to other portions of the frame or covers.

Figure 7:
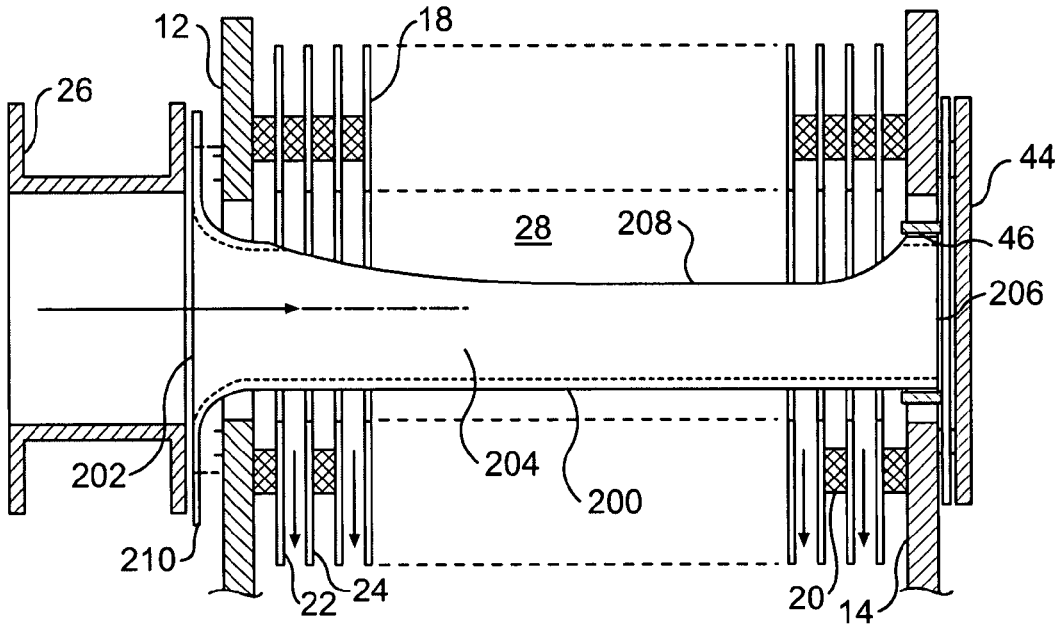
FIG. 7 is a schematic side view in partial section of an insert disposed within a heat exchanger in accordance with a further embodiment of the invention.

FIG. 7 shows a modified insert 200 that is mounted directly to the cover. Insert 200 has a converging nozzle 202 at the first end, a body 204, and a second end 206. The outlet 208 is formed as a contoured opening as in the configuration of FIG. 6. A mounting flange 210 extends from the nozzle 202 and is sealed to the stationary cover element 12. The second end 206 is mounted to a sleeve 46 extending from the blind flange 44.

Figure 8:
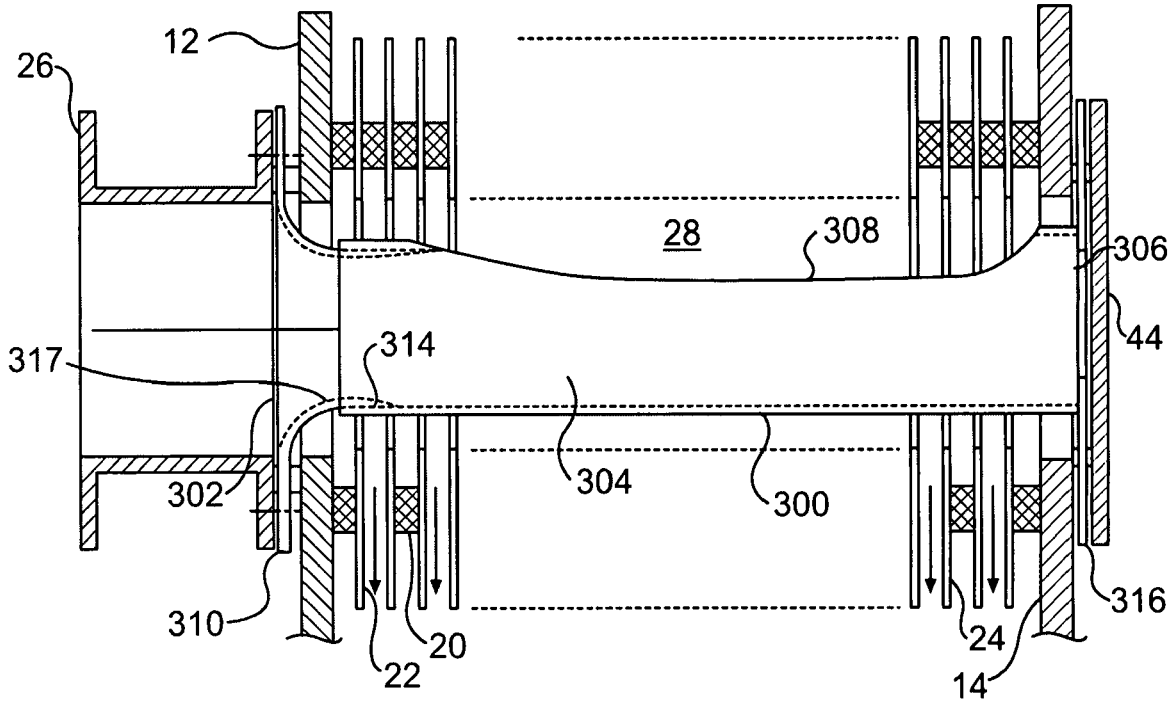
FIG. 8 is a schematic side view in partial section of an insert disposed within a heat exchanger in accordance with another embodiment of the invention.

In FIG. 8, the insert 300 is formed with a separate converging nozzle. The insert 300 has a converging nozzle 302, a body 304 and second end 306. The outlet 308 is a contoured opening as in the embodiment of FIG. 6. A mounting flange 310 extends from the opening at the converging nozzle 302 and is mounted to the cover element 12. The converging nozzle 302 has an open end 312 that fits into the open end 314 of the body 304 in a press fit manner to form a substantially fluid tight connection. A mounting flange 316 is also disposed at the second end 306 for sealing connection to the movable cover element 14. The separate nozzle can be used in any of the inserts in accordance with this invention.

Figure 9:
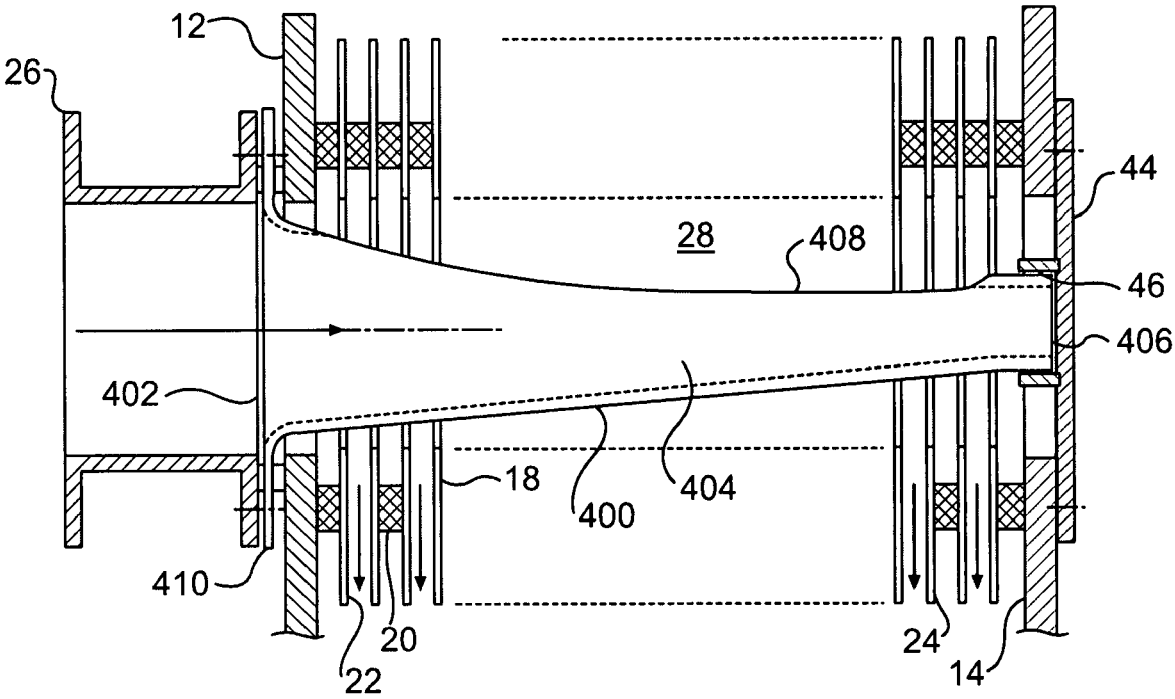
FIG. 9 is a schematic side view in partial section of an insert disposed within a heat exchanger in accordance with an additional embodiment of the invention.

FIG. 9 shows an embodiment in which the body of the insert is tapered. The insert 400 has a converging nozzle 402, a body 404 and a second end 406. An outlet 408 is formed as an opening in the side wall of the body 404 as described above. The insert 400 has a mounting flange 410 for sealing connection to stationary cover element 12. The blind flange 44 has a sleeve 46 for supporting the second end 406 also as described above. In this configuration, the body 408 is generally conical and tapers from the first end toward the second end. This shape also assists in flow distribution as the cross section of the hollow interior chamber influences the velocity and volume of the fluid exiting the insert 400.

Figure 11:
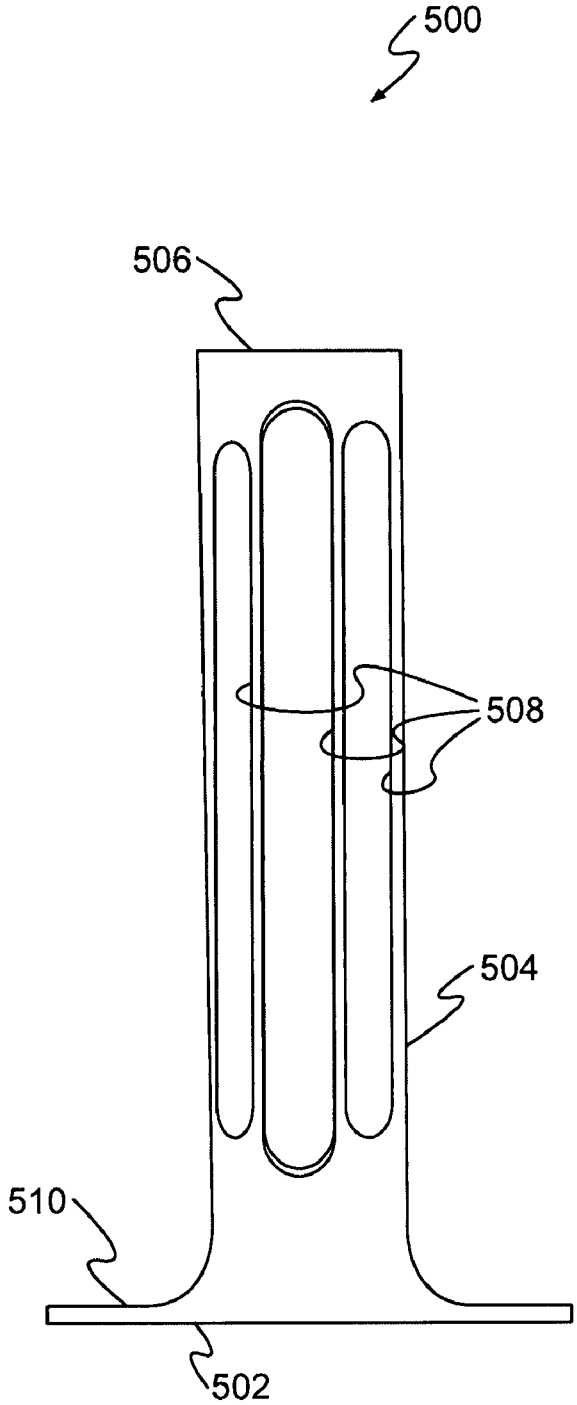
FIG. 11 is a top view of an insert similar to the insert of FIG. 7 with a modified outlet.

As noted above, the outlet may be formed as a contoured opening with the precise shape depending on the desired fluid dynamics. It is also possible to form the outlet as a series of openings, such as elongated slots as shown in FIG. 11. The insert 500 in this case also has a converging nozzle 502, a body 504, and a second end 506. Outlet 508 includes slotted openings that can vary in size. Perforations or other shaped openings may also be used.

The inserts shown in FIGS. 1-5 are very simple in design and thus allow lower manufacturing costs, while still being very effective at minimizing vibration and associated wear to the heat transfer elements 18. While the inserts shown in FIGS. 6-11 are more complex, the mounting mechanisms used at both ends of the insert provide increased stability and stiffness in large installations.

As will be evident, the various mounting arrangements may be adapted for the various different insert designs and used in any combination. Also, the mounting flanges may be secured to various portions of the cover elements 12, 14 or the plate pack 16. The illustrations are intended to show examples of the various combinations possible in accordance with the invention, but are not intended to be limiting.

All of these configurations allow easy installation and removal of the inserts through either cover element depending on the particular design. For example, the insert can be accessed by removing the inlet port 26 spool and/or the blind flange 44. The insert is well suited by this for retrofitting into existing plate heat exchangers.

An advantage of the insert in accordance with this invention is that the fluid flow entering and exiting the heat exchanger can be modified by effectively altering the size of the ports and port manifolds with the insert and deflecting high velocity flow while using standard plate pack assemblies. Standard sized heat transfer elements can be used with the insert without modification to the heat exchanger plate, which would be very expensive and inefficient for individualized installations. The insert can be manufactured relatively inexpensively and installed during assembly or retrofit into existing plate heat exchangers to reduce wear and ultimate replacement of the heat transfer plates. This offers a huge cost savings in preventing throughput losses and repair and replacement costs to plate heat exchangers, particularly large plate heat exchangers used in refineries, for example.

Various modifications can be made in our invention as described herein, and many different embodiments of the device and method can be made while remaining within the spirit and scope of the invention as defined in the claims without departing from such spirit and scope. It is intended that all matter contained in the accompanying specification shall be interpreted as illustrative only and not in a limiting sense.

What is claimed is:

1. A heat exchanger, comprising:

a heat exchanger assembly including a port for passage of a heat exchanging fluid, a port manifold extending from the port and having a length and a port manifold diameter, and heat transfer elements disposed along the length of the port manifold and having flow channels in communication with the port manifold for passage of the heat exchanging fluid to accomplish heat exchange; and an insert disposed in the port manifold of the heat exchanger assembly, the insert comprising a converging nozzle, a tubular body extending from the converging nozzle and an outlet formed in the tubular body, wherein the converging nozzle extending into the port manifold and having a hollow interior with decreasing internal diameter such that the internal diameter of the converging nozzle adjacent the port is greater than the internal diameter of the converging nozzle adjacent the tubular body, wherein the tubular body has a tubular body internal diameter that is less than the port manifold diameter, and wherein the outlet having a periphery and a rounded lip extending about the periphery, and wherein heat exchanging fluid flows between the port and the port manifold via the insert through the converging nozzle, the tubular body and the outlet, wherein a flow space is defined along the length of the port manifold and extends between the tubular body and the heat transfer elements, wherein the heat transfer elements comprise a pack of heat exchanger plates coupled together in a stacked, spaced relationship, and the flow channels are formed between adjacent heat exchanger plates, wherein the insert extends in a first direction coextensive with the port and the heat exchanger plates are stacked in the first direction such that the flow channels extend in a second direction substantially perpendicular to the first direction, wherein the pack of heat exchanger plates includes at least two entrance plates disposed adjacent to the port, wherein the insert extends at least as far as the entrance plates into the port manifold.

2. The heat exchanger of claim 1, wherein the second diameter is between about 50% and 90% of the first diameter.

3. The heat exchanger of claim 1, wherein the port manifold has a first length and the insert has a second length extending from the nozzle to the outlet, wherein the second length is less than the first length.

4. A plate heat exchanger, comprising:

a frame including a first cover element and a second cover element, wherein fluid ports are formed in at least one of the first cover elements and the second cover elements;

a heat transfer unit mounted to the frame including a plurality of interconnected spaced heat transfer elements that define port manifolds in communication with each fluid port, wherein heat exchange flow channels are defined between adjacent heat transfer elements that communicate with the port manifolds; and an insert positioned in at least one of the port manifolds in fluid communication with the associated fluid port, wherein the insert includes a converging nozzle extending into the manifold, a hollow body extending from the nozzle, wherein the converging nozzle having a hollow interior with decreasing internal diameter such that the internal diameter adjacent the fluid port is greater than the internal diameter adjacent a the hollow body, and an outlet formed in the hollow body through which fluid flows between the insert and the port manifold, wherein the outlet having a periphery and a rounded lip extending about the periphery, wherein the insert forms a barrier that deflects direct fluid flow between the fluid port and the flow paths away from the heat transfer elements that are positioned adjacent to the fluid port.

5. The plate heat exchanger of claim 4, wherein the outlet is an open end of the hollow body.

6. The plate heat exchanger of claim 4, wherein the insert is between about 2% and 25% of the entire length of the port manifold.

7. The plate heat exchanger of claim 4, wherein the hollow body is about 50% to 90% of the diameter of the port manifold.

* * * * *